US009834351B2

(12) United States Patent
Benedetti et al.

(10) Patent No.: US 9,834,351 B2
(45) Date of Patent: Dec. 5, 2017

(54) CAPSULE FOR SUBSTANCES TO BE MIXED AT THE TIME OF USE

(71) Applicant: BIODUE S.P.A., Tavarnelle Val di Pesa (IT)

(72) Inventors: Vanni Benedetti, Florence (IT); Roberto Nisica, Sorbolo (IT)

(73) Assignee: BIODUE S.P.A., Tavarnelle Val di Pesa (IT)

( * ) Notice: Subject to any disclaimer, the term of this patent is extended or adjusted under 35 U.S.C. 154(b) by 0 days.

(21) Appl. No.: 15/033,771

(22) PCT Filed: Mar. 20, 2015

(86) PCT No.: PCT/IB2015/052052
§ 371 (c)(1),
(2) Date: May 2, 2016

(87) PCT Pub. No.: WO2015/173661
PCT Pub. Date: Nov. 19, 2015

(65) Prior Publication Data

US 2017/0057712 A1 Mar. 2, 2017

(30) Foreign Application Priority Data

May 16, 2014 (IT) ..... MO2014A0140

(51) Int. Cl.

| | |
|---|---|
| ***B65D 25/08*** | (2006.01) |
| ***B65D 51/28*** | (2006.01) |
| ***B65D 41/32*** | (2006.01) |
| ***B65D 41/34*** | (2006.01) |
| ***B65D 39/00*** | (2006.01) |

(52) U.S. Cl.
CPC ..... *B65D 51/2842* (2013.01); *B65D 39/0052* (2013.01); *B65D 41/325* (2013.01); *B65D 41/34* (2013.01); *B65D 51/28* (2013.01); *B65D 51/2828* (2013.01)

(58) Field of Classification Search
CPC B65D 25/08; B65D 39/0052; B65D 51/2864; B65D 51/2857; B65D 51/2842; B65D 51/2828; B65D 81/3266
USPC ..... 206/219–222, 568; 215/6, 228
See application file for complete search history.

(56) References Cited

U.S. PATENT DOCUMENTS

| | | | |
|---|---|---|---|
| 5,769,263 | A | 6/1998 | Willingham et al. |
| 6,015,054 | A | 1/2000 | King et al. |
| 2002/0008116 | A1 | 1/2002 | Sorenson et al. |

(Continued)

FOREIGN PATENT DOCUMENTS

WO 2004087517 A1 10/2004

*Primary Examiner* — Luan K Bui
(74) *Attorney, Agent, or Firm* — Pearne & Gordon LLP

(57) ABSTRACT

The invention relates to an improved capsule for substances to be mixed at the time of use. The capsule object of the present invention is applied to close the mouth (1*a*) of a container (1) containing a solvent (10), and comprises a first part (2), of the known type, intended to be connected to the mouth of the container, and a second part (3), connected to the first part, by a wall (4) which firmly closes the bottom (3*a*) of the second part (3) and the mouth of the container intended to contain the active substance; the second part has an open upper mouth (3*b*), which is closed by hermetically removable sealing means when the second part contains the active substance.

12 Claims, 2 Drawing Sheets

(56) References Cited

U.S. PATENT DOCUMENTS

| | | | | |
|---|---|---|---|---|
| 2005/0211579 | A1* | 9/2005 | Makita | B65D 51/2842 206/219 |
| 2006/0118435 | A1* | 6/2006 | Cronin | B65D 47/243 206/219 |
| 2006/0191932 | A1 | 8/2006 | Bocola | |
| 2008/0202950 | A1* | 8/2008 | Anderson | B65D 51/2842 206/219 |
| 2009/0065379 | A1* | 3/2009 | Casey | B65D 81/3222 206/221 |
| 2009/0139882 | A1* | 6/2009 | DeJonge | B65D 51/2892 206/219 |
| 2010/0276308 | A1* | 11/2010 | Lee | B65D 51/2864 206/219 |
| 2013/0228486 | A1 | 9/2013 | Buck | |

* cited by examiner

CAPSULE FOR SUBSTANCES TO BE MIXED AT THE TIME OF USE

FIELD OF THE ART

The present invention relates to an improved capsule for substances to be mixed at the time of use.

It has been long known the system according to which a solvent is inserted into a container in order to produce substances to be mixed at the time of use, in particular to add an active substance to a solvent so as to obtain a solution immediately prior to use thereof. Said container is then closed by means of a closure capsule generally obtainable using several parts that can be freely assembled and which are made up of plastic material obtained by injection moulding or the like, in which capsule the active substance is contained. At the time of use the active substance, usually contained in a cutter provided with a cutting edge, is inserted into the container following the rupture of the rupturable bottom of the closure capsule which is obtained by means of the cutting edge.

The substances contained in the cutting edge, which are soluble in the liquid contained in the container and dissolved in said liquid at the time of use, are generally sensitive to humidity both due to problems of a physical nature (they can agglomerate in a non-desired way) and to problems of a chemical nature (they can change their properties); the latter is very often the reason why these preparations involve insertion of the active substance into the solvent only at the moment of use thereof.

The materials the reservoirs containing the active substance are made of, are by their nature permeable to humidity even if to a small extent; said permeability involves a modest impact on the thickest zones of the reservoirs, as the time it takes for the humidity to migrate in such zones is very long. This phenomenon instead assumes a great importance in close proximity to the circumferential line of the reservoir along which the cutting takes place, as the thickness of said circumferential line is extremely thin, and the time the humidity takes for migrating over this line is significantly shorter. This phenomenon leads to deterioration of the chemical-physical characteristics of the active substance contained in the reservoir, or at least of part of it, within a relatively short time.

Attempts have been made to manufacture the reservoirs using plastic materials having a lower humidity permeability in order to obviate the above drawback. However it has to be considered that these materials have characteristics that make it extremely difficult to provide cutting by means of cutters which are commonly used, therefore this is not helpful to solve the problem, but it rather slows down its solution. Use thereof was thus practically abandoned.

An alternative solution implies inserting an active substance into the reservoir in greater quantity than what is needed; in such a way, even if part of the active substance deteriorates, a sufficient quantity thereof remains long enough for the intended purposes due to the fact that its deterioration occurs progressively. However, besides providing results that are not always appreciable in terms of final product, this method is particularly costly.

A further solution is to indicate an expiration date on the package which takes into account the time for humidity being absorbed via the reservoir circumferential cutting line, which time is usually much shorter than the time effectively needed by the active substance to degrade. Also this solution is rather expensive.

A further solution consists in adding preservatives to the active substance; This solution, in addition to not be very appreciable, could become impractical following the entry into force of new regulations.

STATE OF THE ART

Also known are solutions providing to insert the active substance into a bubble or "blister" hermetically sealed and associated with the capsule in a position close to the mouth of the container, which capsule is broken so as to allow the active substance to fall into the container. Even this kind of solution does not perfectly solve the problem.

Capsules are also known, for example those described in US 2002/008116 and U.S. Pat. No. 6,015,054, wherein the openable bottom of the reservoir containing the active substance is not in direct contact with the inside of the container which contains the solvent. Such capsules however are complex in terms of manufacturing and uneasy in use.

AIM OF THE INVENTION

Aim of the present invention is to obviate the above drawbacks by providing a capsule easy in use and able to prevent the humidity from coming in contact with the active substance almost fully.

An advantage of the present invention is to provide a capsule attainable on the base of simple assembling techniques tested over a long time.

A further advantage of the present invention is to provide a cost-effective capsule in terms of achievement.

A further advantage of the present invention is to provide a capsule enabling the use of preservatives, so as to favour the correct conservation of the active substance, without these two substances being mixed.

BRIEF DESCRIPTION OF THE DRAWINGS

Further characteristics and advantages of the present invention will better emerge from the detailed description that follows of an embodiment of the capsule object of the present invention, illustrated by way of non-limiting example in the accompanying figures wherein.

DETAILED DESCRIPTION OF PREFERRED EMBODIMENTS OF THE INVENTION HEREIN

Figure 2:
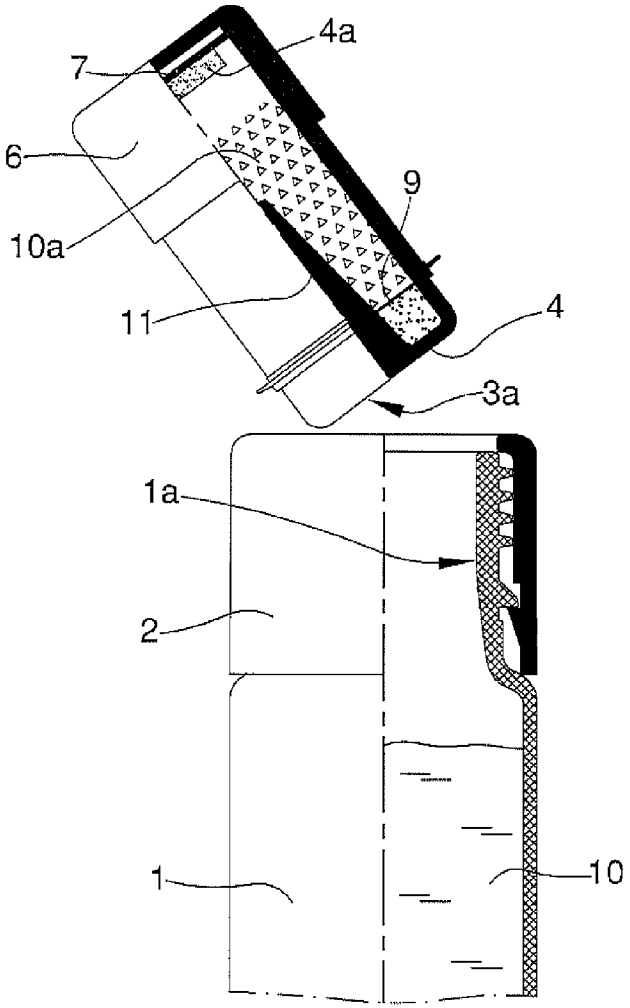
FIG. 2 shows a view in vertical elevation of the disclosed capsule with some parts thereof illustrated in section and other parts only partially illustrated, in which capsule the second part thereof was detached from the first part.
Figure 1:
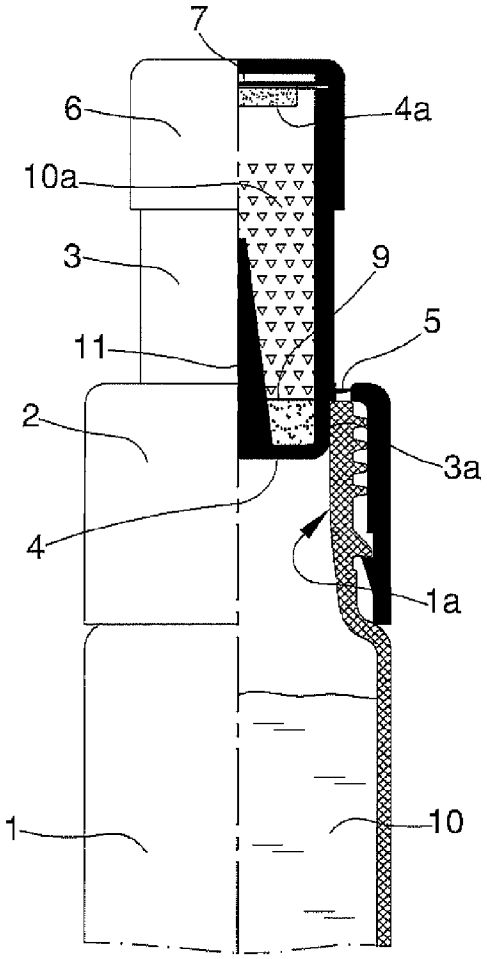
FIG. 1 shows a view in vertical elevation of the disclosed capsule inserted in a container, with some parts thereof illustrated in section and other parts only partially illustrated.
Figure 4:
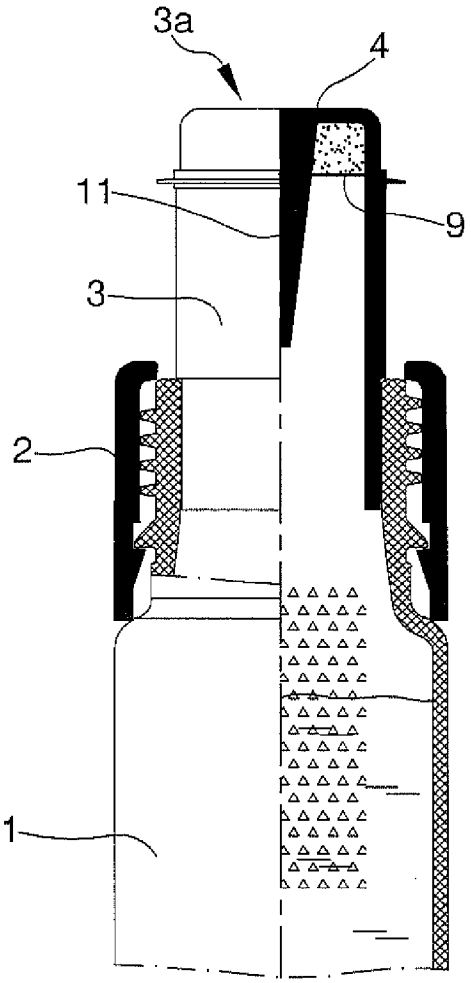
FIG. 4 shows a view in vertical elevation of the disclosed capsule with some parts thereof illustrated in section and other parts only partially illustrated, in which capsule the second part thereof is inserted into the mouth of the container after its contents was introduced into the container.
Figure 3:
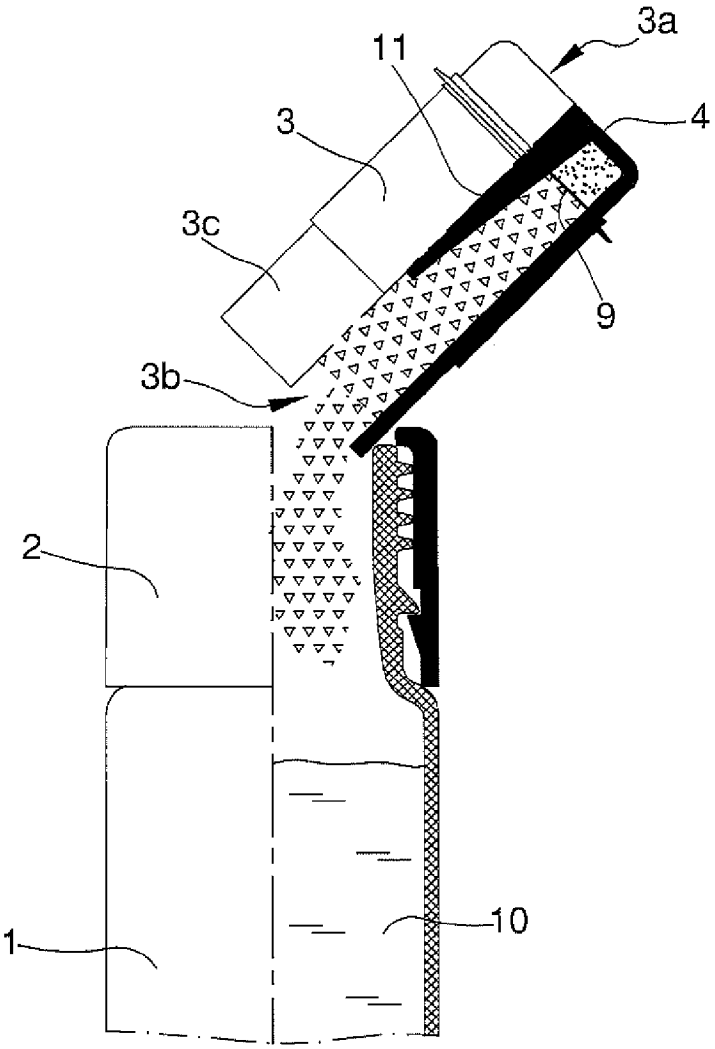
FIG. 3 shows a view in vertical elevation of the disclosed capsule with some parts thereof illustrated in section and other parts only partially illustrated, in which capsule the second part thereof, separate from the first one, has been inverted and deprived of the removable hermetically sealing means, and its content is introduced into the container.

First and foremost it should be noted that the lowered and raised positions, or top and bottom positions as indicated in the present description, are referred to a capsule arranged on a container laying in a horizontal plane.

The capsule disclosed is used for packages containing substances, typically a solvent 10 and an active substance 10*a*, to be mixed at the time of use; such a capsule, which is intended to close the mouth 1*a* of a container 1 containing the solvent, comprises a reservoir destined to include an active substance.

The capsule of the invention comprises a first part 2 which is intended to be connected to the mouth of the container; this first part is of the known type and can be connected to the mouth of the container by means of an interlocking screw system, or any other known system. Preferably, for the reasons which will become apparent hereinafter, the first part 2 of the capsule is irremovably connected to the mouth of the container; obviously the connection is to be intended as irremovable unless operations are carried out which exert force on the capsule thus causing deformation thereof. According to the type of mouth of the container to which the capsule is to be connected, a link of the type as above mentioned, can for example provide that the first part is screwed on the mouth thus engaging the same, or that it simply engages the mouth of the container. If need be, a security strip of the known type may be provided on the first part of the capsule.

The capsule further comprises a second part 3 which is connected to the first part by a wall 4 which firmly closes the bottom 3*a* of the second part 3 as well as the mouth of the container; this second part is intended to contain the active substance. A zone of the second part 3 which is located below the upper wall of the first part 2, has a diameter enabling the introduction thereof into the mouth of the container.

The wall 4, and in particular the part of said wall which is intended to close the bottom of the second part 3 of the capsule, is thick and thus not breakable when the capsule is being used; the upper mouth 3*b* of the second part is instead open.

A capsule of this type can be easily realized in one piece with usual moulding operations of the known type of plastic materials, the first and second part of the capsule as well as the wall 4 are made of.

Removable hermetically sealing means are provided which are intended to close the upper mouth 3*b* of the second part 3 when the latter contains the active substance. Said removable hermetically sealing means of the known type, may for example comprise a multi-layered sheet 7, wherein at least one layer consists of aluminum, which is heat-sealed on the upper mouth 3*b* of the second part 3 when the latter contains the active substance.

The capsule further comprises an easy-to-break ring 5, which is concentric relative to the first and second part of the capsule and which allows detachment of the first part from the second part thereof when the capsule itself is being used, so that the part of the wall 4 that closes the second part of the capsule remains connected to said second part. Preferably the easy-to-break ring 5 is formed on the upper surface of the first part 2 of the capsule and has a diameter which is larger than the diameter of the second part 3 and smaller than that of the first part 2; however such easy-to-break ring can also be afforded, for example, on the external surface of the first part of the capsule, below the wall portion 4 which closes the second part of the capsule.

For reasons which will become apparent hereinafter, the second part 3 of the capsule exhibits an upper zone 3*c* which diameter is smaller than the diameter of the underlying zone of the second part and is approximately equal to the diameter of the mouth of the container; between the upper zone 3*c* and the underlying zone of the second part 3 a small abutment ring is thus obtained.

The second part 3 of the capsule can also be realized with a truncated-cone shape and exhibit the upper zone with diameters increasing from the top downwards, until the diameter of the mouth of the container is reached.

In order to avoid that at least the upper part of the second part 3 of the capsule being in direct contact with the external environment, a cover element 6 of the known type can be provided, enabling to cover at least an upper zone of the second part 3 so as to isolate it from the external environment. Such cover element may for example be realized with a cap, as shown in the figure, or with a heat-shrink tubing covering the capsule at least partially, and in particular the second part thereof.

The cover element 6 can further be realized with a part of the multi-layered sheet 7. In this case the sheet 7 includes a part exceeding outwards with respect to the mouth on which the sheet is welded; even in this case such exceeding part, normally of an annular shape, is folded and tightened around an upper zone of the second part 3 so as to isolate it from the external environment.

On the bottom 3*a* of the second part 3 of the capsule, a hygroscopic substance of the known type can be inserted prior to inserting the active substance, which hygroscopic substance is suitable for absorbing any humidity inside the second part 3 of the capsule.

If the hygroscopic substance is not wanted to come in contact with the active substance, or such substance to be introduced into the solvent together with the active substance, a barrier element 9 can be afforded to separate the substance present on the bottom 3*b* from the active substance; said barrier element may for example constitute an osmotic barrier enabling interaction between the hygroscopic substance and the active substance, though preventing the two substances from being mixed and the hygroscopic substance from falling into the solvent.

Preferably the capsule of the invention comprises a stem-like structure 11 arranged inside the second part 3 of the capsule and firmly connected to the wall part 4 in a concentric manner, which wall part 4 closes the bottom of the capsule second part. Said stem-like structure is obtained during the moulding of the capsule with the same material the capsule is made of, and preferably has a truncated-cone shape with the tapered part facing inside the capsule.

The presence of the stem-like structure 11 has numerous advantages: in addition to promoting a correct moulding of the capsule also facilitating an effective disintegration of the powder contained therein, the stem-like structure 11 makes it easy to stably place the barrier element 9 which, in such a case, will obviously be equipped with a central hole through which it can be inserted into the stem-like structure.

A disc 4*a* of hygroscopic substance is finally provided which is welded internally to the removable hermetically sealing means, realized by the multi-layered sheet 7 in the case illustrated, so as to be internal to the part 3 of the capsule when the mouth 3*b* of such part 3 is closed by aforesaid closing means. This disc as well helps to absorb any humidity inside the second part 3 of the capsule.

Of course, depending on the type of active substance in the capsule, it is also possible to not provide the presence of any hygroscopic substance inside the part 3, but only the presence of the substance 4 or of the disc 4*a*, or provide for the presence of both of these last elements, as shown in the figures.

The disclosed capsule is realized and used as described below.

With a single moulding operation there are afforded the first part, the second part, with possible presence of the stem-like structure 11, the wall and the easy-to-break ring of the capsule. In the second part of the capsule, which performs the function of the reservoir for the active substance, is then introduced the possible hygroscopic substance 4 with the element 9 and the active substance from the upper mouth 3*b* thereof. The mouth 3*b* is then closed with the hermetically sealing means and possible cover element. The capsule thus packaged is then inserted onto the mouth of the container containing the solvent.

The main benefit of the capsule object of the present invention, is that its reservoir, i.e. the second part thereof containing the active substance, is separate by a wall from the inside of the container where the solvent is contained, which wall, as said, can exhibit a remarkable thickness as it doesn't have to be open. There is therefore no danger that humidity coming from inside the container can transmigrate inside the reservoir thus contaminating the active substance, nor does humidity enter from the upper part of the reservoir facing toward external air. It should however be noted that any eventual small humidity amount present within the capsule is absorbed by the substance 4 and/or the disc 4*a*. It is thus realized a capsule which perfectly protects the active substance contained therein.

When ready to use, the second part of the capsule is detached from the first part, for example by performing a bending or rotating movement which causes breakage of the easy-to-break line; during this step, which also enables the mouth of the container to be released, the first part of the capsule remains anchored to the mouth of the container since the same is irremovably fixed thereto.

The possible cover element and the sealing means are then removed from the second part of the capsule which is now free from the rest of the package, in such a way that the upper part of the second part of the capsule can be released. Once the capsule has been inverted, the second part thereof is inserted into the mouth of the container so as to cause the active substance to fall into the solvent. This step is facilitated by the presence of the stem-like structure 11 preventing substance clots from forming or substantially limiting formation thereof.

Thanks to the presence of the zone having a diameter equal to that of the mouth of the container or a truncated-cone shape, the upper part is inserted into the mouth of the container so as to plug it. In such a position, the second part of the capsule can be used as a cover for reclosing the container and possibly reopening it subsequently.

Unlike from the above, a capsule inserted in a removable manner can also be provided being equipped with a security strip on the container; this solution does not require an easy-to-break ring and the capsule is completely detached from the container by removing the security strip.

Once the above operation has been performed, the capsule can be used as previously described, except from the fact that the user will not only have the second part of the capsule but the whole of it in his hand.

This solution as well enables to preserve however the most important technical aspect of the capsule disclosed, that is to provide a reservoir (namely the second part of the capsule), exhibiting the inlet and outlet mouth of the active substance from the opposite side with respect to the mouth of container containing the solvent, and to provide the bottom of the reservoir facing the container inwardly with a thick and tear-resistant wall.

With this solution the advantage is obtained to maintain the active substance clearly separate from the solvent until use thereof, thus preventing any humidity passage from the inside of the container towards the inside of the capsule second part.

The invention claimed is:

1. An improved capsule for substances to be mixed at the time of use, of the type to be applied so as to close the mouth (1*a*) of a container (1) containing a solvent (10) and of the type comprising: a first part (2), of the known type, intended to be connected to the mouth of the container; a second part (3), connected to the first part by a wall (4), which wall (4) firmly closes the bottom (3*a*) of the second part (3) and the mouth of the container which acts as a reservoir and is destined to contain an active substance (10*a*), wherein the second part exhibits an open upper mouth (3*b*), and removable hermetically sealing means are provided intended to close the upper mouth (3*b*) of the second part (3), when the latter contains the active substance; characterized in that it comprises an easy-to-break ring (5), concentric to the first and second part, suitable for enabling detachment of the first and the second part of the capsule; the easy-to-break ring (5) is arranged so that the wall (4) that closes the second part of the capsule remains connected to the second part.

2. A capsule according to claim 1, characterized in that the second part (3) has an upper zone (3*c*) which diameter is smaller than the diameter of the below zone of the second part, and is approximately equal to the diameter of the container mouth.

3. A capsule according to claim 1, characterized in that the second part (3) is of a truncated-cone shape and has an upper zone which diameters are increasing from the top downwards, until the diameter of the mouth of the container is reached.

4. A capsule according to claim 1, characterized in that the first part (2) of the capsule is irremovably connected to the mouth of the container.

5. A capsule according to claim 1, characterized in that the easy-to-break ring (5) is afforded on the upper surface of the first part (2) of the capsule and it has a diameter which is larger than the diameter of the second part (3) and smaller than that of the first part (2).

6. A capsule according to claim 1, characterized in that the easy-to-break ring (5) is obtained on the external surface of the first part of the capsule below the wall (4) closing the second part of the capsule.

7. A capsule according to claim 1, characterized in that it comprises a covering element (6), of the known type, designed for covering at least an upper zone of the second part (3) to isolate it from the external environment.

8. A capsule according to claim 1, characterized in that said removable hermetically sealing means comprises a multi-layered sheet (7), wherein at least one layer is aluminum which is heat-sealed on the upper mouth (3*b*) of the second part (3) when the latter contains the active substance.

9. A capsule according to claim 1, characterized in that: a hygroscopic substance is inserted on the bottom (3*a*) of the second part (3) of the capsule before the active substance; there is provided a barrier element (9) so as to separate the substance present on the bottom (3*b*) from the active substance.

10. A capsule according to claim 1, characterized in that it comprises a disc (4*a*) of a hygroscopic substance which is internally welded to the removable sealing means so as to be inside the second part (3) of the capsule when the upper mouth (3*b*) of the second part (3) is sealed by the above mentioned hermetically sealing means.

11. A capsule according to claim 1, characterized in that it comprises a stem-like structure (11) being arranged inside the second part (3) of the capsule and firmly connected to the wall (4) which closes the bottom (3*a*) of the second part (3) of the capsule; the stem-like structure (11) is fashioned during the moulding of the capsule using the same material used for the capsule.

12. A capsule according to claim 11, characterized in that the stem-like structure (11) is connected concentrically to the wall (4) which closes the bottom (3*a*) of the second part (3) and it is of a truncated cone shape with the tapered part facing inwardly the capsule.

* * * * *